US006375582B1

(12) United States Patent
Harris

(10) Patent No.: US 6,375,582 B1
(45) Date of Patent: Apr. 23, 2002

(54) GOLF SWING AID WITH ALIGNMENT AND POSITIONING RULE

(76) Inventor: George P. Harris, 2447 Baywood Dr. West, Dunedin, FL (US) 34698

( * ) Notice: Subject to any disclaimer, the term of this patent is extended or adjusted under 35 U.S.C. 154(b) by 0 days.

(21) Appl. No.: 09/682,720

(22) Filed: Oct. 10, 2001

(51) Int. Cl.[7] ..... A63B 53/06; A63B 53/16; A63B 57/00; A63B 69/36

(52) U.S. Cl. ..... 473/270; 473/217; 473/207; 473/266

(58) Field of Search ..... 473/147, 217, 473/218, 266, 270, 271, 452, 458, 464, 212, 214, 276; 482/105; 33/289, 339, 342

(56) References Cited

U.S. PATENT DOCUMENTS

| | | | | |
|---|---|---|---|---|
| 771,938 | A | * 10/1904 | Ruhl | 36/132 |
| 1,677,728 | A | 7/1928 | Robinson | |
| 1,936,143 | A | 11/1933 | Shea | |
| 2,220,291 | A | 11/1940 | Savoy | |
| 2,498,006 | A | 2/1950 | Ridill | |
| 2,626,151 | A | 1/1953 | Jenks | |
| 3,300,219 | A | 1/1967 | Sipos | |
| 3,343,842 | A | 9/1967 | Woerner | |
| 3,430,348 | A | * 3/1969 | Quenot | 242/381.3 |
| 3,606,341 | A | 9/1971 | Honbarger | |
| 5,016,885 | A | 5/1991 | Quigley | |
| 5,062,643 | A | 11/1991 | Bibbey et al. | |
| 5,096,199 | A | 3/1992 | Wyatt, Jr. et al. | |
| 5,303,927 | A | 4/1994 | Perry et al. | |
| 5,810,673 | A | 9/1998 | Castleberry | |
| 5,827,128 | A | 10/1998 | Finch et al. | |
| 5,947,832 | A | 9/1999 | Gagne | |
| 6,086,483 | A | 7/2000 | Brown | |

* cited by examiner

*Primary Examiner*—Paul T. Sewell
*Assistant Examiner*—Alvin A. Hunter, Jr.
(74) *Attorney, Agent, or Firm*—Ronald E. Smith; Smith & Hopen, P.A.

(57) ABSTRACT

A training device worn by a golfer includes a first shoe retainer that is secured to a first shoe of the golfer and a second shoe retainer that is secured to a second shoe of the golfer. In a first embodiment, a housing is pivotally mounted to a toe end of the first retainer and a post is mounted to the toe end of the second retainer. An axle is rotatably mounted in the housing and a first tape measure is coiled about the axle and has a first end secured to the axle. A second tape measure is coiled about the axle and has a first end secured to the axle in diametrically opposed relation to the first end of the first tape measure. The axle is biased so that both tape measures are coiled about it when in repose.

10 Claims, 5 Drawing Sheets

GOLF SWING AID WITH ALIGNMENT AND POSITIONING RULE

BACKGROUND OF INVENTION

1. Field of the Invention

This invention relates, generally, to the game of golf. More particularly, it relates to a device that helps a golfer to swing a golf club.

2. Description of the Prior Art

A golfer learning the game will be told by more experienced players to imagine a line extending through the ball to a target hole, and to stand squarely when facing that imaginary line. A golfer squarely facing the imaginary line will have shoulders in parallel relation to the imaginary line and feet aligned perpendicular thereto. The golfer is said to have proper alignment when so positioned. The beginner will also be told that foot spacing is important. However, there is no universal tool for teaching golfers how to stand relative to the imaginary line and how far apart the feet should be.

Numerous devices have been developed to assist golfers in swinging golf clubs, but none of them help the golfer stand squarely relative to the imaginary line from the ball to the target hole and none of them help a golfer to learn what his or her ideal foot spacing is. For example, U.S. Pat. No. 1,936,143 to Shea discloses foot braces that are adjustable along the length of a transverse slot and longitudinal slots. U.S. Pat. No. 2,220,291 to Savoy discloses a spacer device attachable to a golfer's shoe. Ridill, in U.S. Pat. No. 2,498,006, provides a harness that interconnects a golfer's feet with a strap. None of these devices help the golfer visualize an imaginary line from the ball to the target hole or teach the golfer how to stand squarely with respect to such imaginary line nor do they help the golfer learn his or her ideal foot spacing. Many other putt or swing training devices are known; most of them require the golfer to spend a lot of time putting the devices on and taking them off. As a result, they have not been accepted by golfers.

There remains a need, therefore, for a device that helps the golfer visualize such an imaginary line, which helps the golfer align the body with respect thereto, and which conveys information to the golfer concerning foot spacing during the swinging of a golf club. Specifically, there is a need for a device that produces a physical, tangible line that points toward the target hole so that the golfer can align squarely therewith and that tells the golfer the distance between his or her feet during the swing. A need exists as well for a device that a golfer can put on and take off quickly and easily.

However, in view of the prior art considered as a whole at the time the present invention was made, it was not obvious to those of ordinary skill in the pertinent art how the identified needs could be fulfilled.

SUMMARY OF INVENTION

The longstanding but heretofore unfulfilled need for a device that helps golfers improve their putting game is now met by a new, useful, and nonobvious invention.

A primary object of the invention is to provide an apparatus that accomplishes the dual purpose of telling a golfer how far apart his or her feet are when preparing to make a golf swing and providing to the golfer a tangible straight line that indicates the desired path of travel for the golf ball during the shot so that the golfer may align his or her body squarely therewith.

Another object is to provide golf pros with a training device that is easily attachable to a user's shoes and just as easily removable therefrom.

Another closely related object is to provide such a device that provides accurate measurement between a user's feet even if the user does not position his or her feet in parallel relation to one another.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
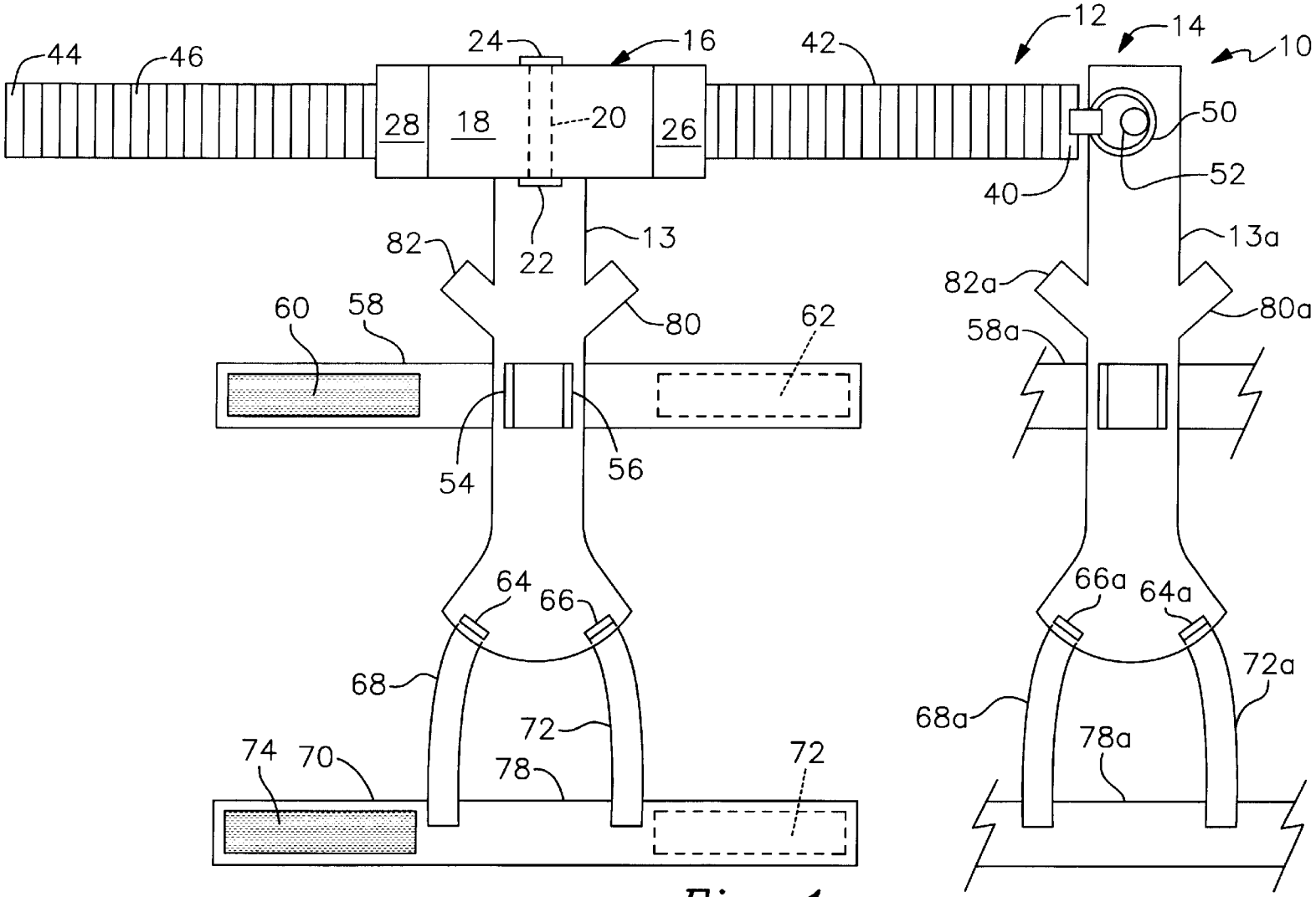
FIG. 1 is a top plan view depicting an illustrative embodiment of the invention when its two maim parts are interconnected in laterally spaced apart relation to one another.

Referring to FIG. 1, it will there be seen that the reference numeral 10 denotes an illustrative embodiment of the present invention.

The novel golf swing aid including an alignment and positioning rule is denoted as a whole by the reference numeral 10. It includes a left shoe retainer 12, a right show retainer 14, and a ruler housing 16 that is mounted to the distal free end of left shoe retainer 12.

As best understood in connection with FIGS. 1–4, housing 16 includes a hollow cylindrical main chamber 18. Axle 20, secured at its opposite ends by fasteners 22, 24, is coincident with the axis of symmetry of cylindrical main chamber 18. A first wing 26 and a second wing 28, both of which are also of hollow construction, extend radially with respect to axle 20 in diametric opposition to one another.

Housing 16 is supported at wings 26, 28 by a frame 30 (FIGS. 3 and 4) having a flat bottom wall 32 and diverging arms 34, 36. Flat bottom wall 32 is centrally apertured and that central aperture is aligned with an aperture formed in the distal free end of left show retainer 12. A pivot pin 38 extends through said aligned apertures so that housing 16 is rotatable three hundred and sixty degrees (360°) about said pivot pin.

Figure 2:
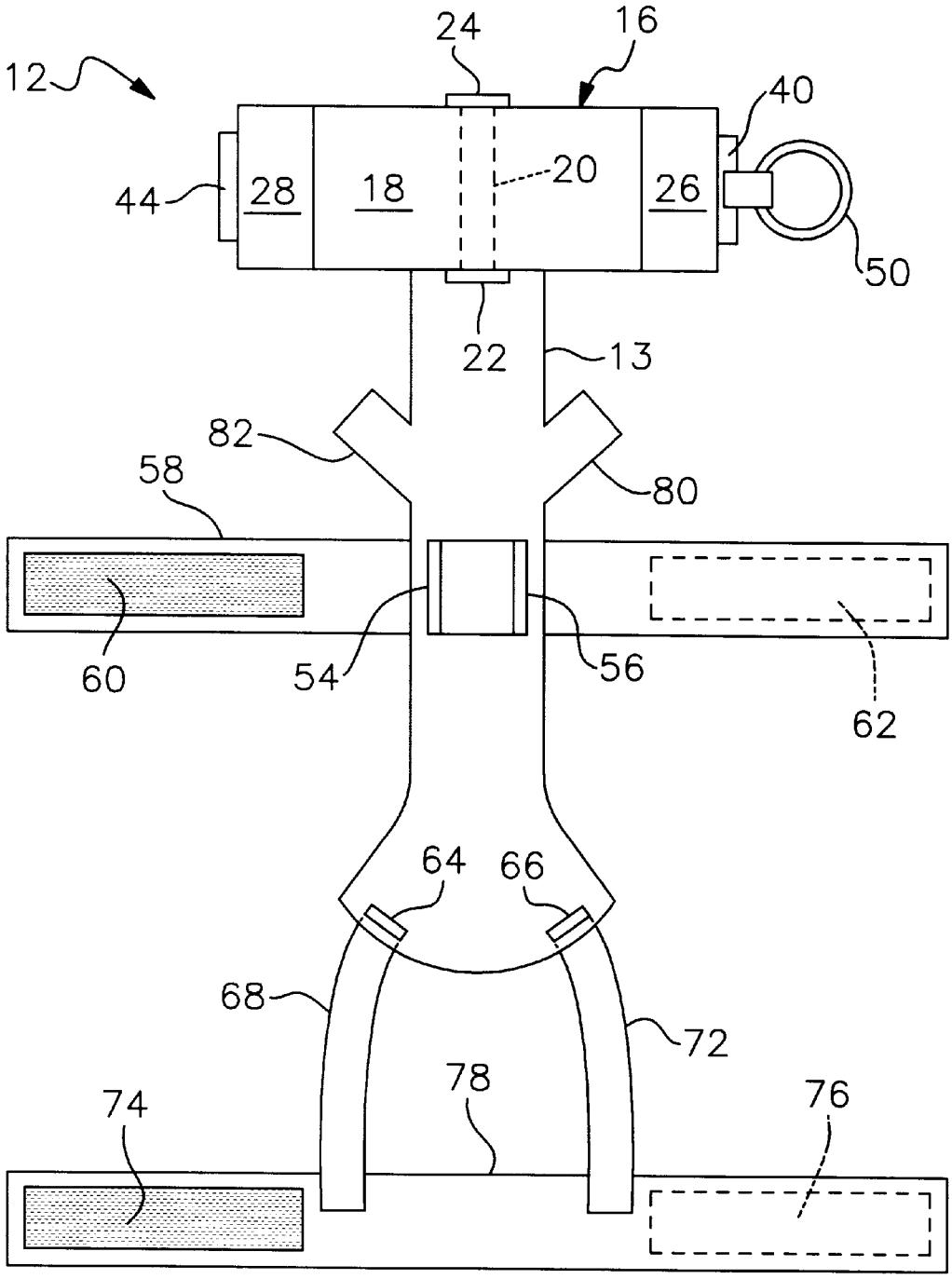
FIG. 2 is a top plan view of a first shoe retainer when disconnected from the second shoe retainer.
Figure 7:
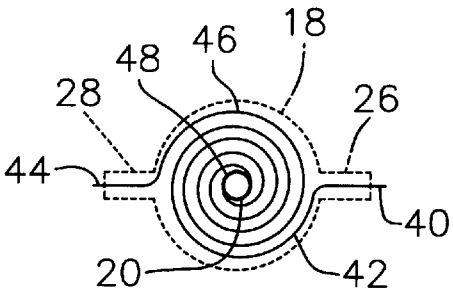
FIG. 7 is a diagrammatic end view of the interior of the ruler housing.

A free end 40 of a first flexible ruler 42 extends just slightly out of first wing 26 when first shoe retainer 12 is in repose as depicted in FIG. 2. A free end 44 of a second flexible ruler 46 extends just slightly out of second wing 28 when said first and second flexible rulers are in their respective coiled positions of repose. As best understood on connection with FIG. 7, a bias means 48 ensleeves axle 20 and maintains said rulers in their coiled positions of repose until an external force overcomes its bias. When the novel device is in use in the manner disclosed below, the spreading apart of the user's feet overcomes the bias. Thus, as the feet are spread apart, the rulers simultaneously extend from opposite sides of the housing by a corresponding amount and as the feet are placed closer together, the rulers retract into the housing under the influence of the bias means. FIG. 1 depicts the shoe retainers when interconnected to one another and when they have been laterally spread apart relative to one another by a user.

A rigid ring 50 (FIGS. 1–4) is secured to free end 40 of first ruler 42. An upstanding post 52 (FIGS. 1, 5, and 6) is fixedly secured to the distal free end of right shoe retainer 14. Post 52 extends through the opening defined by ring 50 when putting aid 10 is in use as indicated in FIG. 1.

A pair of slots 54, 56 (FIG. 1) are formed in base 13 of left shoe retainer 12 about mid-length thereof and a first elongate strap member 58 having a width slightly less than the extent of the slots is fed therethrough so that it is engaged mid-length thereof by said slots. A pad 60 covered with the loop part of a hook and loop fastener is sewn to a first end of the strap on a first side thereof and a pad 62 covered with the hook part of such a fastener is sewn to a second end of the strap on a second side thereof so that when a user wearing golf shoes places a left golf shoe atop left shoe retainer 12, the opposite ends of strap 58 are easily wrapped around the instep of the shoe and fastened to one another, securing the shoe in place.

An outboard slot 64 and an inboard slot 66 are formed in the trailing end of left shoe retainer base 13. An outboard strap 68 has a first end secured to outboard slot 64 and a second end secured to a second elongate strap member 70. An inboard strap 72 has a first end secured to inboard slot 66 and a second end secured to said second elongate strap member 70. A pad 74 covered with the loop part of a hook and loop fastener is sewn to a first end of second elongate strap member 70 and a pad 76 covered with the hook part of such a fastener is sewn to a second end of said second elongate strap member. Medial part 78 of strap member 70 is positioned behind a user's ankle and the strap is then wrapped therearound to further secure the user's left shoe to left shoe retainer base 13.

Figure 3:
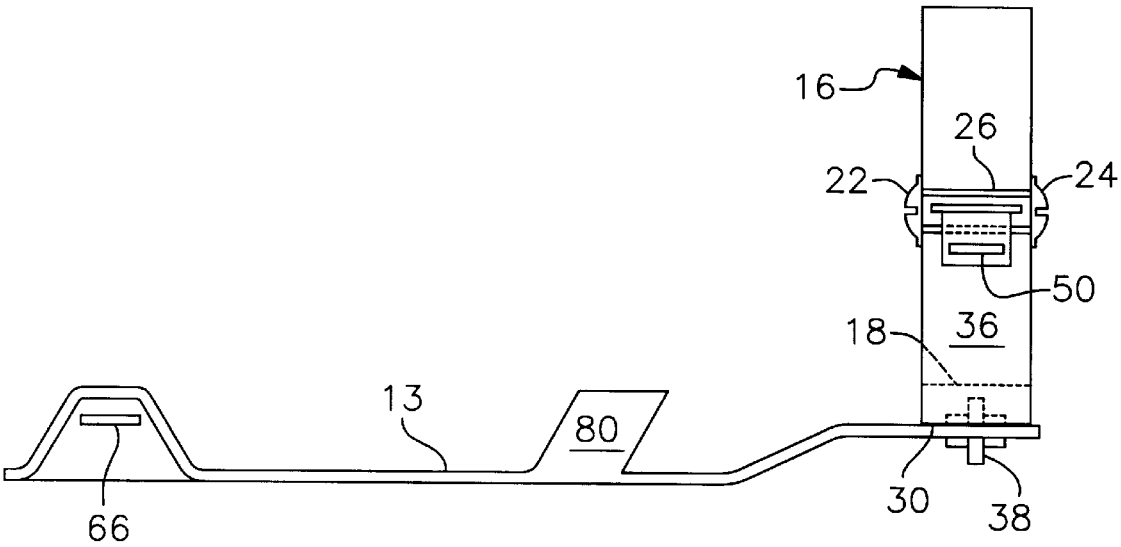
FIG. 3 is a side elevational view of the first shoe retainer.
Figure 4:
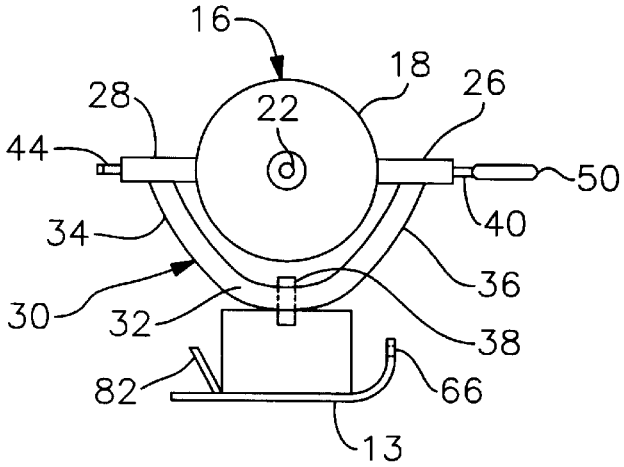
FIG. 4 is an end view of the first shoe retainer.

A pair of shoe toe-aligning wings, denoted 80 and 82, are formed integrally with base 13 and are upturned as best depicted in FIG. 3; they perform the function their name expresses.

The structure of right shoe retainer 14 is a mirror image of the structure of left shoe retainer 12. Accordingly, the respective parts thereof are denoted by a reference numeral that is similar to the reference numeral that denotes the corresponding part of the left shoe retainer.

Figure 5:
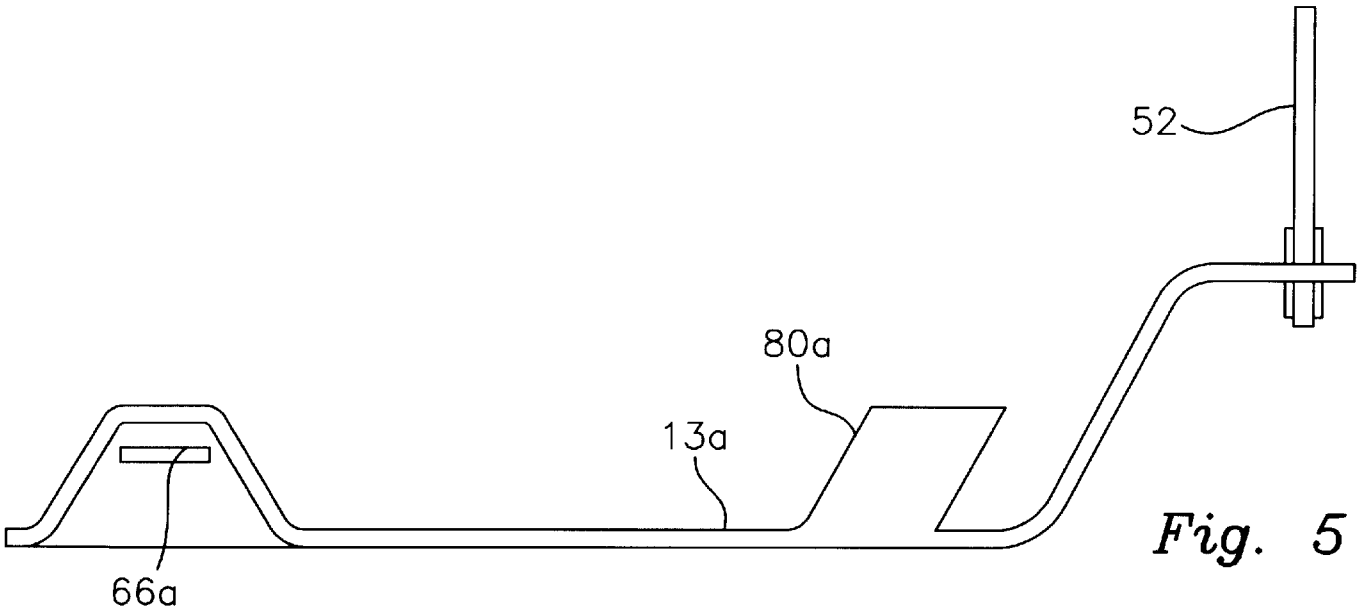
FIG. 5 is a side elevational view of the second shoe retainer.
Figure 6:
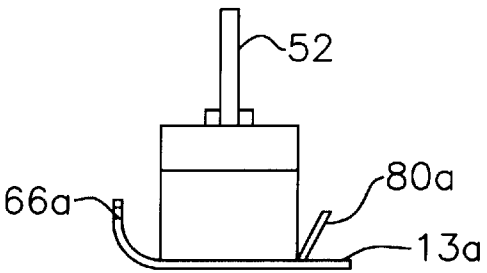
FIG. 6 is an end elevational view of the second shoe retainer.

It should also be observed that shoe retainers 12 and 14 can be reversed so that the left show retainer becomes the right shoe retainer and vice versa. Housing 16 is simply rotated one hundred eighty degrees (180°) about pivot pin 38 so that ring 50 may engage post 52. The distal end of shoe retainer base 13*a* that supports post 52 is bent for elevation as depicted in FIG. 5 so that post 52 is positioned at substantially the same level as ring 50 when shoe retainer bases 13 and 13*a* are positioned atop a support surface.

Novel putting aid 10 is used by strapping the left and right shoes of the golfer to the left and right shoe retainers 12 and 14, respectively. Ring 50 is brought into engagement with post 52 and the feet are spread apart into a putting or other golf swing stance. The spacing between the feet is read, in inches, at the edge of right wing 26 if housing 16 is mounted to left shoe retainer 12 and said spacing is read at the edge of left wing 28 if said housing is mounted on right shoe retainer 14. An equal length of the opposing ruler extends simultaneously from the opposite wing, and the two ruler lengths therefore collectively provide a straight line that is positioned in parallel relation to an imaginary line drawn from the golf ball to the target hole. The golfer then stands squarely relative to the straight line and swings the club in parallel relation to the straight line defined by the rulers, thereby ensuring an accurate golf shot. A golf pro advising the golfer can record the distance between the golfer's feet during a series of shots to thereby determine the optimal foot spacing for the golfer. The golfer can then practice making shots with that foot spacing, using the extended rulers as a guide for each shot until sufficient practice eliminates the need for novel device 100.

Figure 8:
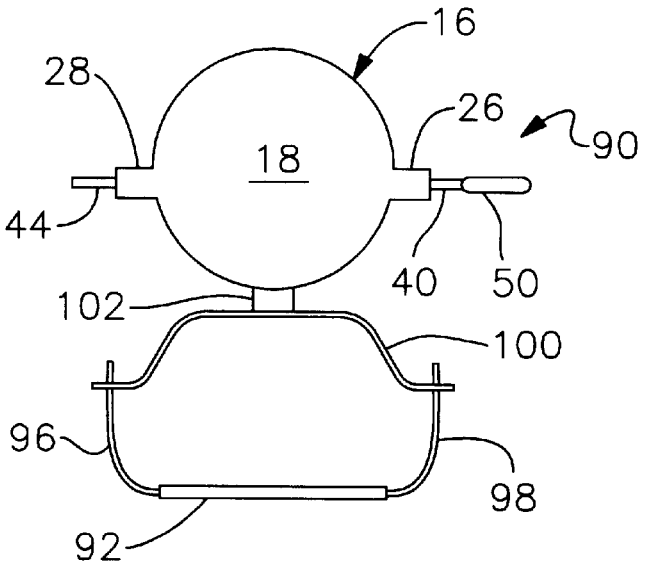
FIG. 8 is an end view of a first shoe retainer of a second embodiment.
Figure 9:
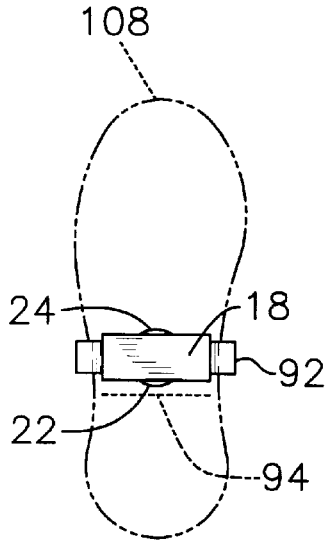
FIG. 9 is a top view of the structure depicted in FIG. 8.

A second embodiment, denoted 90 as a whole, is depicted in FIGS. 8–11. In this embodiment, only a vestige of shoe retainers 13, 13*a* remains. Specifically, a truncate plate 92 (FIGS. 8 and 9) fits under a user's shoe 108, just forwardly of heel 94 thereof. Strap 96 has a first end secured to a first end of truncate plate 92 and strap 98 has a first end secured to a second end of said truncate plate. The respective free ends of straps 96, 98 are secured to opposite ends of a rigid plate 100 (FIG. 8). A swivel means 102 surmounts rigid plate 100 and supports housing 16 in vertical alignment with rigid plate 100.

Figure 10:
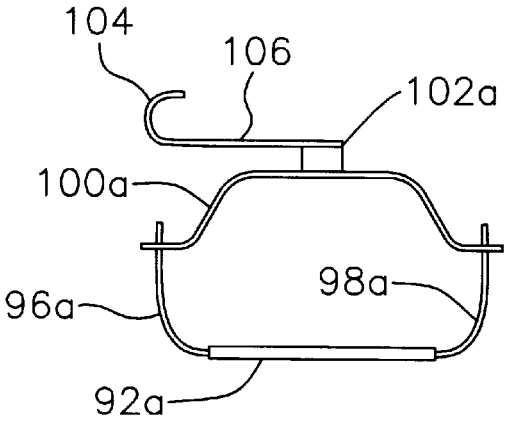
FIG. 10 is an end view of a second shoe retainer of said second embodiment.
Figure 11:
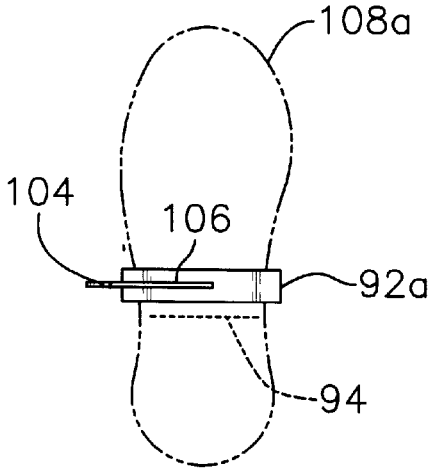
FIG. 11 is a top view of the structure depicted in FIG. 10.

As indicated in FIGS. 10 and 11, where similar reference numerals are employed to indicate similar parts, straps 96*a*, 98*a* extend from opposite sides of truncate plate 92*a* and said straps engage opposite ends of rigid plate 100*a*. Post 102*a* surmounts said rigid plate 100*a* but it does not swivel as does its counterpart 102. Hook 104 is formed at the distal free end of rigid arm 106 which is cantilevered to post 102*a*. The length of arm 106 is sufficient to position hook 104 just beyond the inboard side of a user's right shoe 108*a* to facilitate engagement of ring 50 by said hook when the user's shoes are positioned close to one another. After hook 104 has engaged ring 50, the user's shoes are spread apart as in the first embodiment, and tapes 42, 46 simultaneously extend from wings 26, 26 of housing 18 as in the first embodiment.

Thus, the second embodiment functions in substantially the same way as the first embodiment, but it requires fewer materials to make. Truncate shoe retainers 92, 92*a* require much less material than elongate shoe retainers 13, 13*a*, for example. However, the primary advantage of the second embodiment is its vertical alignment of housing 18 in relation to truncate plate 92 and its vertical alignment of hook 104 in relation to truncate plate 92*a*. By positioning truncate plates 92 and 92*a* about mid-length of each shoe, ring 50 and hook 104 are likewise positioned mid-length of each shoe. This produces a more accurate measurement of the spacing between the user's shoes because the measurement is independent of the position of the user's toes. In the first embodiment, if a user's toes point out, or if one of them points out with respect to the other, or if both toes point in, or one points in with respect to the other, a false reading of the spacing between the shoes results. By centrally positioning housing 18, the effect of the user's stance relative to toe positioning is minimized. In other words, an accurate reading of the distance between the user's feet is obtained, even of the feet are not held in parallel relation to one another.

Both embodiments of the novel device are quickly and easily attachable to shoes and just as quickly and easily detachable thereform. Placing the ring and post in engaging relation to one another is a very simple task, and disengaging them is just as simple. Accordingly, this invention provides golf swing-teaching features heretofore unavailable while being free of the difficulties associates with many golf swing-teaching aides.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A device for teaching a golfer how to stand when making a golf swing, comprising:

a first shoe retainer adapted to releasably engage a first golf shoe worn by a golfer;

a second shoe retainer adapted to releasably engage a second golf shoe worn by said golfer;

a housing mounted to said first shoe retainer;

an axle rotatably mounted in said housing;

a first flexible tape measure coiled within said housing, said first flexible tape measure having a first end secured to said axle;

a second flexible tape measure coiled within said housing, said second flexible tape measure having a first end secured to said axle in diametric opposition to said first end of said first flexible tape measure;

said housing including a pair of diametrically opposed exit ports; said first flexible tape measure having a distal free end that extends slightly from a first exit port of said pair of exit ports when said axle is in repose;

said second flexible tape measure having a distal free end that extends slightly from a second exit port of said pair of exit ports when said axle is in repose;

an annular ring secured to said distal free end of said first flexible tape measure; and a ring-engaging means secured to said second shoe retainer;

whereby when said ring-engaging means engages said ring, said first and second flexible tape measures extend through their respective exit ports in opposite directions, forming a straight linear structure, when said golfer's feet are spread apart;

whereby said golfer adjusts his or her position so that said straight linear structure is in parallel relation to an imaginary line that extends from a golf ball to a target golf hole; and whereby said first flexible tape measure is calibrated so that the distance between said golfer's feet is displayed by said first ruler.

2. The device of claim 1, further comprising a bias means positioned within said housing that maintains said first and second flexible tape measures in a coiled, retracted position of repose when said ring-engaging means is not engaged to said ring, said bias means causing said first and second flexible tape measures to retract into said housing as said first and second shoe retainers converge toward one another.

3. The device of claim 1, wherein said housing is pivotally mounted to said first shoe retainer means for rotation about a vertical axis.

4. The device of claim 1, wherein said first shoe retainer has an elongate structure including a heel end and a toe end and wherein said housing is mounted to a toe end of said first shoe retainer.

5. The device of claim 4, wherein said second shoe retainer has an elongate structure including a heel and a toe end and wherein said ring-engaging means is an upstanding post mounted to a toe end of said second shoe retainer.

6. The device of claim 1, wherein said first shoe retainer has a transverse dimension slightly greater than a shoe width and a nominal longitudinal dimension.

7. The device of claim 6, further comprising a first flexible strap secured to a first end of said first shoe retainer and a second flexible strap secured to a second end of said first shoe retainer.

8. The device of claim 7, further comprising a rigid plate disposed in surmounting relation to said first shoe retainer, said rigid plate being connected at its opposite ends to said first shoe retainer by said first and second flexible straps.

9. The device of claim 8, wherein said housing is disposed in surmounting relation to said rigid plate.

10. The device of claim 9, wherein said first shoe retainer is adapted to be positioned slightly forwardly of a heel of a shoe, said housing being adapted to be positioned about mid-length between a heel and a toe of a said shoe.

* * * * *